US009718199B2

(12) United States Patent
Yagyu

(10) Patent No.: US 9,718,199 B2
(45) Date of Patent: Aug. 1, 2017

(54) SCISSORS FOR HAIRDRESSING

(71) Applicant: YAGYU CO., LTD., Hiroshima (JP)

(72) Inventor: Matsuo Yagyu, Hiroshima (JP)

(73) Assignee: YAGYU CO., LTD., Hiroshima (JP)

( * ) Notice: Subject to any disclaimer, the term of this patent is extended or adjusted under 35 U.S.C. 154(b) by 0 days.

(21) Appl. No.: 14/580,082

(22) Filed: Dec. 22, 2014

(65) Prior Publication Data

US 2015/0101198 A1 Apr. 16, 2015

Related U.S. Application Data

(63) Continuation of application No. PCT/JP2014/000971, filed on Feb. 25, 2014.

(30) Foreign Application Priority Data

Apr. 11, 2013 (JP) ..... 2013-082846

(51) Int. Cl.
*B26B 13/28* (2006.01)
*B26B 13/00* (2006.01)

(52) U.S. Cl.
CPC ..... *B26B 13/285* (2013.01); *B26B 13/28* (2013.01)

(58) Field of Classification Search
CPC ..... B26B 13/28; B26B 13/285; B26B 13/16
USPC ..... 30/251, 261, 266
See application file for complete search history.

(56) References Cited

U.S. PATENT DOCUMENTS 1,814,821 A * 7/1931 Botts ..... B26B 13/28 30/261
2,238,014 A * 4/1941 Dalley ..... B26B 13/28 30/266
2,436,560 A * 2/1948 Feather ..... B26B 13/28 30/266
3,672,053 A 6/1972 Wiss

FOREIGN PATENT DOCUMENTS

JP H02-124197 A 5/1990
JP 2007-175203 A 7/2007
JP 2013-081748 A 5/2013

OTHER PUBLICATIONS

International Search Report; PCT/JP2014/000971; May 27, 2014.

* cited by examiner

*Primary Examiner* — Laura M Lee
(74) *Attorney, Agent, or Firm* — Studebaker & Brackett PC

(57) ABSTRACT

In opening and closing scissors, separation between both blades caused by inclination of one blade body relative to the other blade body is prevented or reduced. Specifically, with a head being in contact with a movable blade, a coil spring comes into contact with a head at one end and with the bottom of a counterbore at the other end. This pressing force allows a stationary blade to tightly abut on the movable blade. A taper face is formed at the stationary blade side of the head to press and expand the one end of the coil spring radially outside a pivot.

2 Claims, 3 Drawing Sheets

SCISSORS FOR HAIRDRESSING

CROSS-REFERENCE TO RELATED APPLICATION

This is a continuation of PCT International Application PCT/JP2014/000971 filed on Feb. 25, 2014, which claims priority to Japanese Patent Application No. 2013-082846 filed on Apr. 11, 2013. The disclosures of these applications including the specifications, the drawings, and the claims are hereby incorporated by reference in their entirety.

BACKGROUND

The present disclosure relates to a pivot structure of scissors formed by fitting a pivot into a through-hole formed in an intermediate portion of each of first and second blade bodies to pivotably connect the first and second blade bodies together, and more particularly to a pivot structure suitable for hairdressing scissors.

FIG. 1 illustrates a pivot structure of known hairdressing scissors. The pivot structure is formed by fitting a pivot 3 into through-holes 7 and 9 formed in an intermediate portion of each of a first blade body 1 and a second blade body 2, respectively, to pivotably connect the first and second blade bodies 1 and 2 together. The through-holes 7 and 9 of the first and second blade bodies 1 and 2 have counterbores 4 and 5, respectively. A coil spring 6 wound around the pivot 3 is attached to the counterbore 4 of the first blade body 1. A ball bearing 8 is fitted in the counterbore 5 of the second blade body 2. The part of the through-hole 7 except the counterbore 4 has a square cross-section. The part of the through-hole 9 except the counterbore 5 has a circular cross-section.

The center of the pivot 3 serves as an angular shaft 3*b* with a square cross-section. When the pivot 3 is fitted into the through-holes 7 and 9, the angular shaft 3*b* is fitted in the angular part of the through-hole 7, which is the part except the counterbore 4. This pivotably integrates the pivot with the first blade body 1. On the other hand, the pivot 3 is loosely fitted in the circular part of the through-hole 9, which is the part except the counterbore 5. The pivot 3 is in contact with the inner circumferential face of the ball bearing 8. Then, the second blade body 2 is pivotable around the pivot 3.

A brim-like head 3*a* is provided at one axial end of the pivot 3. On the other hand, a screw 12 is screwed at the other axial end of the pivot 3. With the head 12*a* of the screw 12 being in contact with the inner race of the ball bearing 8 (i.e., pressing the inner race), the coil spring 6 comes into contact with the head 3*a* at one end and with the bottom of the counterbore 4 at the other end. This pressing force allows the portion of the first blade body 1 around the pivot to tightly abut on (or to be attached by the spring force to) the portion of the second blade body 2 around the pivot. As a result, the blades (i.e., blade edges) come into close contact with each other. Japanese Unexamined Patent Publication No. 2007-175203 (FIGS. 8 and 9) shows such a pivot structure of scissors including a coil spring.

In the pivot structure shown in FIG. 1, the angular shaft 3*b* of the pivot 3 is slightly loosely fitted in the angular part of the through-hole 7 of the first blade body 1. In opening and closing the scissors, as shown in FIG. 2, the first blade body 1 is thus inclined relative to the second blade body 2 such that the blades (i.e., the blade edges) move away from each other. For example, in the case of hairdressing scissors, hairs may be caught between the blades, thereby hindering smooth opening and closing and clean cutting of the scissors.

The present disclosure addresses the above-described problem of the pivot structure of the scissors including the coil spring as shown in FIG. 1.

In order to solve the above-described problem, the present disclosure provides a creative structure not to incline one blade body relative to the other blade body even if there is a gap between an angular part of a through-hole and an angular shaft.

Specifically, the present disclosure provides a pivot structure of scissors including first and second blade bodies each including a blade at one end side, and a finger ring at the other end side; and a pivot fitted in a through-hole formed in an intermediate portion of each of the first and second blade bodies to pivotably connect the first and second blade bodies together such that the both finger rings move to and away from each other to open and close the both blade bodies at the blades. The present disclosure has the following features.

Specifically, in a first aspect of the invention, a counterbore is formed around the through-hole of one of the blade bodies. Each of first and second brim-like heads is provided at an end of the pivot. A coil spring wound around the pivot is attached to the counterbore. With the first head being in contact with a peripheral edge of the through-hole of the other of the blade bodies, the coil comes into contact with the second head at one end and with a bottom of the counterbore at the other end. Pressing force of the coil spring allows the one of the blade bodies to tightly abut on the other of the blade bodies. A taper pressing part is formed at a blade body side of the second head to press and expand the one end of the coil spring radially outside the pivot.

According to a second aspect of the invention, in the first aspect of the invention, the pivot includes an angular shaft with a polygonal cross-section. A part of the through-hole of the one of the blade bodies except the counterbore is located to correspond to the angular shaft. The part has a polygonal cross-section corresponding to the cross-section of the angular shaft.

According to a third aspect of the invention, in the first or second aspect of the invention, a ring projection projects beyond a peripheral edge of the counterbore. The blade body side of the second head is pressed onto the ring projection.

According to a fourth aspect of the invention, in the third aspect of the invention, a cylindrical sleeve is fitted in the counterbore. A part of the sleeve projecting beyond the counterbore is the ring projection.

In the present disclosure, the coil spring attached to the counterbore is pressed and expanded radially outward by the taper pressing part of the pivot to be pressed onto the inner circumferential face of the counterbore. This integrates the pivot with the one blade body via the coil spring, thereby preventing or reducing backlash at the pivot and separation of the blades (i.e., the blade edges) in use of the scissors. In the case of hairdressing scissors, this prevents hairs from being caught between the blades in use to allow the user to smoothly handle the scissors and maintain clean cutting.

In the case of hairdressing scissors, each blade body often has a small thickness of about 3 mm, and each counterbore has a small depth of about 2 mm. However, the ring projection is formed along the peripheral edge of the counterbore, thereby increasing the depth. This increases the length of the coil spring, which can be included in the counterbore, to a desired length. In addition, the head of the pivot is pressed, thereby applying a concentrated load to the ring projection. The concentrated stress on the ring projection allows the blades to come into close contact with each other to reliably prevent or reduce uplifting of the blades.

Since the ring projection is the sleeve fitted and extending along the peripheral edge of the counterbore, the ring projection can be easily formed, and the height of the ring projection can be easily changed.

DETAILED DESCRIPTION

A pivot structure of scissors according to embodiments of the present disclosure will be described hereinafter with reference to the drawings.

First Embodiment of Invention

Figure 1:
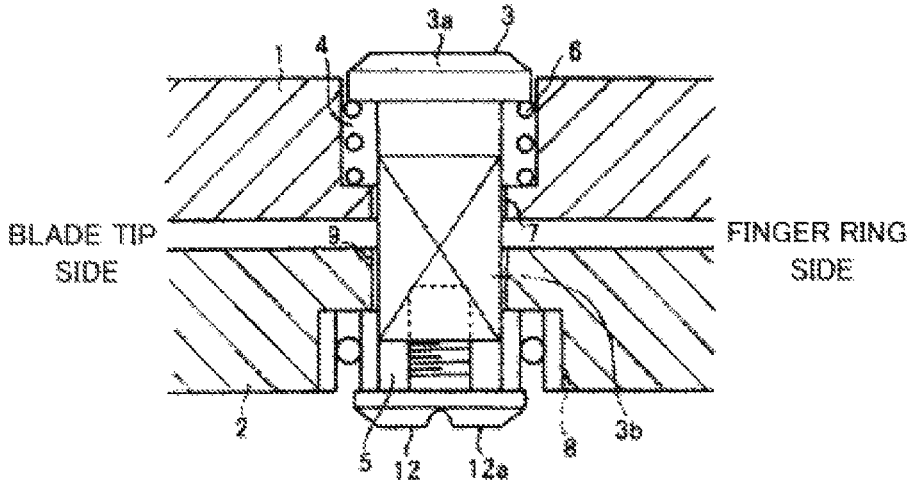
FIG.1 PRIOR ART
FIG. 1 is a cross-sectional view illustrating a known example of a pivot structure of scissors.
Figure 2:
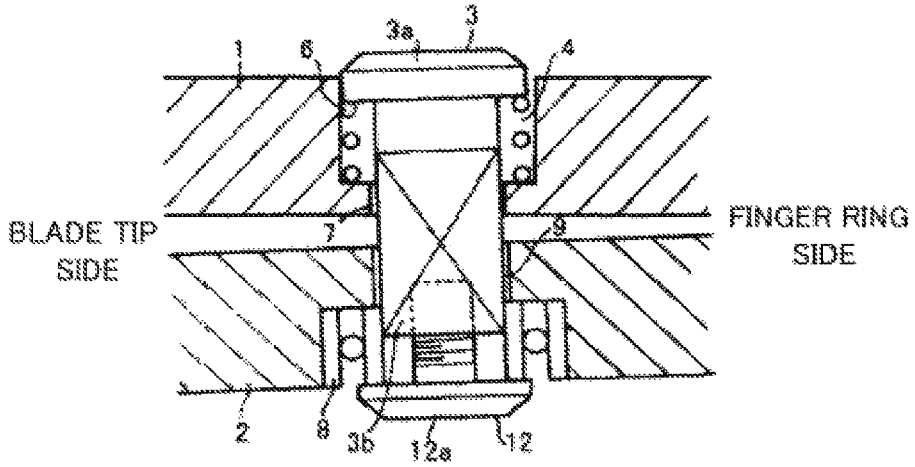
FIG.2 PRIOR ART
FIG. 2 corresponds to FIG. 1 and illustrates that a blade body is inclined to open blades.
Figure 3:
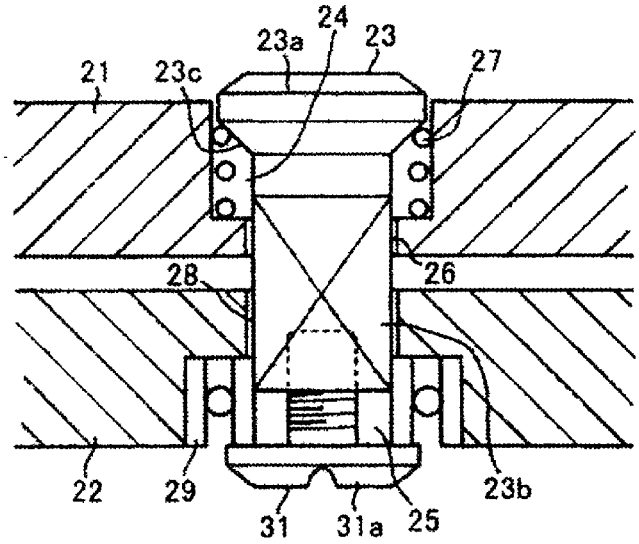
FIG. 3 is a cross-sectional view illustrating a pivot structure of scissors according to a first embodiment of the present disclosure.

FIG. 3 illustrates a pivot structure of scissors according to a first embodiment of the present disclosure. The scissors include a stationary blade (or a first blade body) 21 and a movable blade (or a second blade body) 22, each of which has a blade (not shown) at one end side, and a finger ring (not shown) at the other end side. The middles of the stationary blade 21 and the movable blade 22 are pivotably connected together at a pivot 23. The finger rings move to and apart from each other, thereby opening and closing the stationary blade 21 and the movable blade 22 at the blade sides.

A head (or a second head) 23*a* is provided at one axial end of the pivot 23 to expand radially outside the pivot 23. The head 23*a* has a taper face (or a pressing part) 23*c* at the other axial end (i.e., at the stationary blade 21 side) of the pivot 23. The radius of the taper face gradually decreases with the decreasing distance to the other axial end of the pivot 23.

On the other hand, a setscrew 31 having a head (or a first head) 31*a* is screwable at the other axial end of the pivot 23 from the movable blade 22 side. The setscrew 31 is screwed at the other axial end of the pivot 23 such that the pivot 23 has brims at both ends.

An angular shaft 23*b* with a square cross-section is provided in the middle of the pivot 23.

A through-hole 26 is formed in the middle (i.e., at the pivot) of the stationary blade 21 to penetrate the stationary blade 21. The pivot 23 can be fitted in the through-hole 26.

A counterbore 24 with a circular cross-section is formed around the through-hole 26 at side opposite to the movable blade 22. A coil spring 27 is attached to the counterbore 24.

The part of the through-hole 26 except the counterbore 24 has the same square cross-section as the angular shaft 23*b* (i.e., forms the angular part of the hole). When the pivot 23 is fitted into the through-hole 26, the angular shaft 23*b* is fitted in the position corresponding to the angular shaft 23*b*. This pivotably integrates the pivot 23 with the stationary blade 21.

On the other hand, a through-hole 28 is formed in the middle (i.e., at the pivot) of the movable blade 22 to penetrate the movable blade 22. The pivot 23 can be fitted in the through-hole 28.

A counterbore 25 with a circular cross-section is formed around the through-hole 28 at the side opposite to the stationary blade 21. The part of the through-hole 28 except the counterbore 25 has a circular cross-section (i.e., forms the circular part of the hole).

A substantially disk-like ball bearing 29 is fitted in and attached to the counterbore 25.

When the pivot 23 is fitted into the through-hole 28, the angular shaft 23*b* is loosely fitted in the through-hole 28 and comes into contact with the inner race of the ball bearing 29. Then, the movable blade 22 is pivotable around the pivot 23.

The positions of the through-hole 26 of the stationary blade 21 and the through-hole 28 of the movable blade 22 are matched, and the coil spring 27 is attached to the counterbore 24 of the stationary blade 21. In this state, the pivot 23 passes through the inside of the coil spring 27 from the stationary blade 21 side, while being sequentially fitted into the through-holes 26 and 28. Meanwhile, the setscrew 31 is screwed at the other axial end of the pivot 23. Then, with the head 31*a* being in contact with the inner race of the ball bearing 29 (i.e., the peripheral edge of the through-hole 28), the coil spring 27 comes into contact with the head 23*a* at one end and with the bottom of the counterbore 24 at the other end. This pressing force allows the stationary blade 21 to tightly abut on (or to be impacted on) the movable blade 22. At this time, the taper face 23*c* of the head 23*a* presses and expands one end of the coil spring 27 radially outside the pivot 23 to press the coil spring 27 onto the inner circumferential face of the counterbore 24. This integrates the pivot 23 with the stationary blade 21 via the coil spring 27.

The head 31*a* of the setscrew 31 is in contact with the inner race of the ball bearing 29 (i.e., presses the inner race) to prevent the ball bearing 29 from coming out of the counterbore 25.

As described above, in the first embodiment of the present disclosure, the one end of the coil spring 27, which is attached to the counterbore 24, is pressed and expanded radially outward by the taper face 23*c* of the pivot 23 to be pressed onto the inner circumferential face of the counterbore 24. This integrates the pivot 23 with the stationary blade 21 via the coil spring 27 to prevent or reduce backlash at the pivot and separation between the blades (i.e., the blade edges) in use of the scissors. In the case of hairdressing scissors, this prevents hairs from being caught between the blades in use to allow the user to smoothly handle the scissors and maintain clean cutting.

Second Embodiment of Invention

Figure 4:
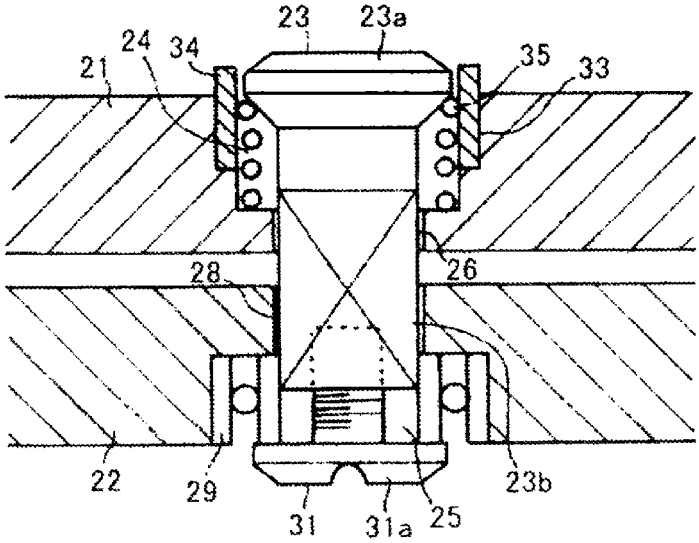
FIG. 4 corresponds to FIG. 3 and illustrates a second embodiment of the present disclosure.

FIG. 4 illustrates a pivot structure of scissors according to a second embodiment of the present disclosure. In the pivot structure of the second embodiment, the structure around a through-hole 28 of a stationary blade 21 is different from that in the first embodiment. The other structures are the same. The differences will be described in detail.

The inner circumferential face of a counterbore 24 is located more outward at side opposite to a movable blade 22 than at the movable blade 22 side. A cylindrical sleeve 33 is fitted in the counterbore 24 at side opposite to the movable blade 22.

The inner circumferential face of the sleeve 33 is flush with the inner circumferential face of the counterbore 24 at the movable blade 22 side. At side opposite to the movable blade 22, the sleeve 33 extends beyond the counterbore 24 to form a ring projection (or a rib) 34 of the present disclosure.

As described above, in the second embodiment of the present disclosure, in the case of hairdressing scissors, each of the stationary blade 21 and the movable blade 22 has a small thickness of about 3 mm, and each of counterbores has a small depth of about 2 mm. However, the depth of the counterbore 24 increases by the amount of the projection of the ring projection 34 of the sleeve 33, thereby reliably including a coil spring 35 with a needed length in the counterbore 24.

Third Embodiment of Invention

Figure 5:
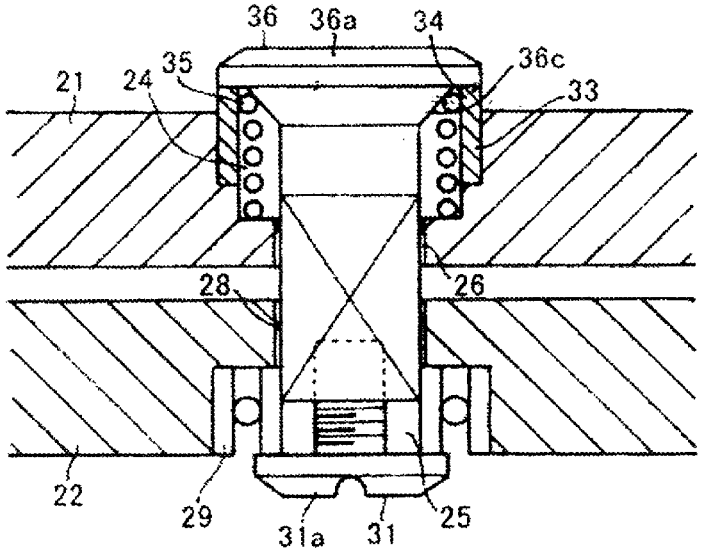
FIG. 5 corresponds to FIG. 3 and illustrates a third embodiment of the present disclosure.

FIG. 5 illustrates a pivot structure of scissors according to a third embodiment of the present disclosure. In the pivot structure of the third embodiment, the structure of a pivot 36 partially differs from that of the second embodiment. The other structures are the same. The differences will be described in detail.

A head (or a second head) 36*a* of the pivot 36 has a flat face at the outer circumference at a stationary blade 21 side. The flat face is continuous with a taper face 36*c*. The flat face of the head 36*a* is pressed onto a ring projection 34 of the sleeve 33. When a setscrew 31 is screwed to press the pivot 36 toward the movable blade 22 side, the head 36*a* presses the ring projection 34, thereby applying a concentrated load to generate concentrated stress. This concentrated stress allows the blade sides of the stationary blade 21 and the movable blade 22 to come into close contact with each other to prevent or reduce uplifting of the blades (i.e., blade edges).

Since the ring projection 34 is the sleeve 33 fitted in a counterbore 24, the ring projection 34 can be easily formed, and the height of the ring projection 34 can be easily changed.

Fourth Embodiment of Invention

Figure 6:
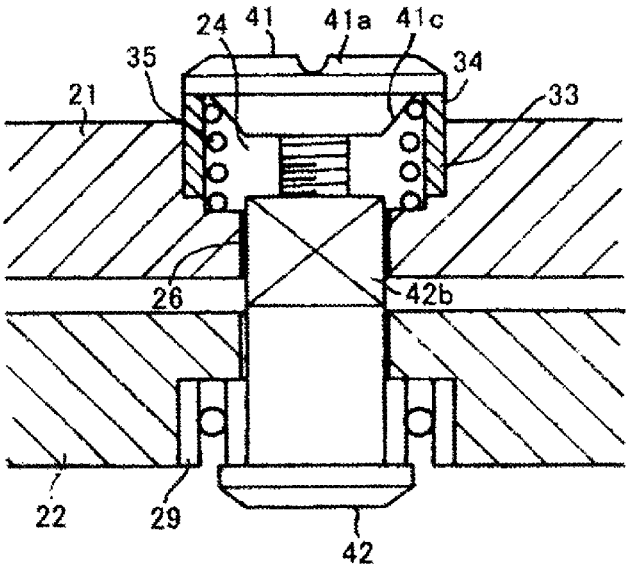
FIG. 6 corresponds to FIG. 3 and illustrates a fourth embodiment of the present disclosure.

FIG. 6 illustrates a pivot structure of scissors according to a fourth embodiment of the present disclosure. In the pivot structure of the fourth embodiment, the structure of a pivot 42 partially differs from that in the third embodiment. The other structures are the same. The differences will be described in detail.

In the fourth embodiment, the pivot 42 is fitted into through-holes 28 and 26 from a movable blade 22 side. An angular shaft 42*b* of the pivot 42 is fitted in the part of the through-hole 26 except a counterbore 24.

A setscrew 41 with a head 41*a* is screwed at the other axial end of the pivot 42. The head 41*a* has a taper face (or a pressing part) 41*c* at the stationary blade 21 side. The radius of the taper face gradually decreases with the decreasing distance to the stationary blade 21.

A head 41*a* has a flat face at the outer circumference at a stationary blade 21 side. The flat face is continuous with the taper face 41*c*. The flat face of the head 41*a* is pressed onto a ring projection 34 of a sleeve 33. When the setscrew 41 is screwed to press the setscrew 41 toward the movable blade 22 side, the head 41*a* presses the ring projection 34, thereby applying a concentrated load to cause concentrated stress. This concentrated stress allows the blade sides of the stationary blade 21 and the movable blade 22 to come into close contact with each other to prevent or reduce uplifting of the blades (i.e., blade edges).

As described above, contrary to the third embodiment, the setscrew 41 of the pivot 42 is located at the stationary blade 21 side in the fourth embodiment of the present disclosure. However, the same advantages as in the third embodiment can be obtained.

In this fourth embodiment, the setscrew 41 may be like the heads 23*a* and 36*a* of the pivots 23 and 36 in the first to third embodiments.

In the first to fourth embodiments, the ball bearing 29 is fitted in and attached to the counterbore 25 of the movable blade 22 such that the pivot 23, 36, or 42 pivotably supports the movable blade 22. In place of the ball bearing 29, a sliding bearing may be used. Instead of screwing the setscrew 31 or 41 into the axial end of the pivot 23, 36, or 42, the axial end of 23, 36, or 42 may be cut into the form of a screw. The screw is projected beyond the movable blade 22, and a nut is screwed on and fixed to the projection. Alternatively, a taper pressing part is formed in a nut, and screwed on a screw formed at the axial end of the pivot 23, 36, or 42. When a sliding bearing pivotably supports the pivot 23, 36, or 42, and a nut is screwed on a screw at the end of the pivot, or when the ball bearing 29 is replaced with a sliding bearing in the fourth embodiment shown in FIG. 6, the counterbore 25 of the movable blade 22 is unnecessary.

While in the first to fourth embodiments of the present disclosure, the angular shaft 23*b* or 42*b* has the square cross-section, it may have other polygonal cross-sections.

While the pivot structure according to the first to fourth embodiments is used as the pivot structure of hairdressing scissors, it may also be used for, for example, dressmaking scissors, etc.

What is claimed is:

1. Scissors for hairdressing, comprising:

first and second blade bodies each including
a blade at one end side,
a finger ring at the other end side; and
a through-hole in its intermediate portion, a pivot fitted in the through-hole to pivotably connect the first and second blade bodies together, such that the finger rings move to and away from each other to open and close the blade bodies at the blades, wherein a counterbore is formed around the through-hole of one of the blade bodies, first and second heads, each of which is provided at an end of the pivot, a coil spring wound around the pivot is attached to the counterbore of the first blade body, a ball bearing is fitted in a counterbore of the second blade body, with the first head being in contact with the ball bearing, the coil spring comes into contact with the second head and with a bottom of the counterbore of the first blade body, pressing force of the coil spring allows the first blade body to tightly abut on the second blade body, a cylindrical sleeve is fitted in the counterbore of the first blade body such that the coil spring is located at an inner side of the sleeve and such that the sleeve is replaceable with another sleeve, a ring projection is provided at a peripheral edge of the counterbore of the first blade body, the ring projection is a part of the sleeve projecting beyond a surface of the first blade body, and the side of the second head facing the first blade body is pressed onto an end of the ring projection, and a taper pressing part is formed at a side of the second head facing the first blade body to press and expand a side of the coil spring at the second head radially from the pivot, and presses the side of the coil spring onto an inner circumferential face of the ring projection.

2. The scissors of claim 1, wherein the pivot includes an angular shaft with a polygonal cross-section, the through-hole of the first blade body is located to correspond to the angular shaft, and the through-hole has a polygonal cross-section corresponding to the cross-section of the angular shaft.

* * * * *